US006107582A

United States Patent [19]

Okutomi et al.

[11] Patent Number: 6,107,582

[45] **Date of Patent: *Aug. 22, 2000**

[54] VACUUM VALVE

[75] Inventors: Tsutomu Okutomi, Kanagawa-ken; Mitsutaka Homma, Saitama-ken; Tsuneyo Seki, Tokyo; Atsushi Yamamoto, Tokyo; Takashi Kusano, Tokyo; Hiromichi Somei, Tokyo, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/145,337

[22] Filed: Sep. 1, 1998

[30] Foreign Application Priority Data

Sep. 1, 1997 [JP] Japan ..... P09-235699

[51] Int. Cl.[7] ..... H01K 1/02; H01H 33/66

[52] U.S. Cl. ..... 200/266; 218/130; 218/132

[58] Field of Search ..... 75/245–247, 243, 75/255, 623, 369; 148/513, 423; 200/264–266; 218/123–125, 130, 132, 146; 252/514, 512; 419/2, 6, 9, 27, 29, 38, 11, 31–33, 46, 53, 55, 23; 420/428, 495, 499–501; 428/548

[56] References Cited

U.S. PATENT DOCUMENTS

| | | | |
|---|---|---|---|
| 3,821,505 | 6/1974 | Wood | 200/144 B |
| 3,960,554 | 6/1976 | Gainer, Jr. | 75/200 |
| 4,530,815 | 7/1985 | Inagaki | 419/8 |
| 5,354,352 | 10/1994 | Seki et al. | 75/245 |
| 5,403,543 | 4/1995 | Okutomi et al. | 419/23 |
| 5,557,083 | 9/1996 | Komuro et al. | 218/125 |
| 5,691,521 | 11/1997 | Komuro et al. | 218/123 |
| 5,697,150 | 12/1997 | Komuro et al. | 29/875 |

FOREIGN PATENT DOCUMENTS

| | | | |
|---|---|---|---|
| 0 099 066 | 1/1984 | European Pat. Off. | B22F 3/26 |
| 0 172 912 | 3/1986 | European Pat. Off. | H01H 33/66 |
| 195 13 790 | 10/1995 | Germany | H01N 1/62 |
| 54-71375 | 6/1979 | Japan . | |

*Primary Examiner*—Michael Friedhofer
*Attorney, Agent, or Firm*—Oblon, Spivak, McClelland, Maier & Neustadt, P.C.

[57] ABSTRACT

A vacuum valve which has a contact material having a constituent of high electrical conductivity such as Cu and an anti-arcing constituent including Cr in which particles whose particle size is in the range 0.1~150 μm represent at least 90 volume %, and a ratio defined by the formula $(\alpha_{900}-\alpha_{50})\times100/(\alpha_{900})$ for this contact material has a value of 8–12% and is the coefficient of thermal expansion of the contact material $\alpha_{50}$ is the coefficient of thermal expansion of the contact material at 50° C. The formation of channels generated at the interfaces of the Cr particles and the Cu matrix after undergoing the brazing step is suppressed, enabling the static withstand-voltage, contact resistance, and the breaking performance characteristics of the vacuum valve to be stabilized.

12 Claims, 11 Drawing Sheets

| CONDITION | CONTACT MATERIAL | | | | | | | | | |
|---|---|---|---|---|---|---|---|---|---|---|
| | HIGH CONDUCTIVITY CONSTITUENT | | ANTI-ARCING CONSTITUENT | | | FIRST AUXILIARY CONSTITUENT | | SECOND AUXILIARY CONSTITUENT | | RATIO OF VALUES OF THERMAL EXPANSION COEFFICIENT (%) |
| EMBODIMENTS COMPARATIVE EXAMPLES | TYPE | CONSTITUENT CONTENT (%) | TYPE | CONSTITUENT CONTENT (%) | PARTICLE SIZE (μm) | TYPE | CONSTITUENT CONTENT (%) | TYPE | CONSTITUENT CONTENT (%) | |
| EMBODIMENT-1 | Cu | 75 | Cr | BALANCE | 70~100 | Al | 0.05 | -- | -- | 0.8 |
| EMBODIMENT-2 | " | " | " | " | " | " | " | -- | -- | 6 |
| EMBODIMENT-3 | " | " | " | " | " | " | " | -- | -- | 12 |
| COMP. EX.-1 | " | " | " | " | " | " | " | -- | -- | 35 |
| COMP. EX.-2 | Cu | 95 | " | " | " | " | " | -- | -- | 2.5 |
| EMBODIMENT-4 | " | 80 | " | " | " | " | " | -- | -- | " |

| CONDITION | CONTACT MATERIAL | | | | | | | | | |
|---|---|---|---|---|---|---|---|---|---|---|
| | HIGH CONDUCTIVITY CONSTITUENT | | ANTI-ARCING CONSTITUENT | | | FIRST AUXILIARY CONSTITUENT | | SECOND AUXILIARY CONSTITUENT | | RATIO OF VALUES OF THERMAL EXPANSION COEFFICIENT (%) |
| EMBODIMENTS COMPARATIVE EXAMPLES | TYPE | CONSTITUENT CONTENT (%) | TYPE | CONSTITUENT CONTENT (%) | PARTICLE SIZE ( μm) | TYPE | CONSTITUENT CONTENT (%) | TYPE | CONSTITUENT CONTENT (%) | |
| EMBODIMENT-1 | Cu | 75 | Cr | BALANCE | 70~100 | Al | 0.05 | -- | -- | 0.8 |
| EMBODIMENT-2 | " | " | " | " | " | " | " | -- | -- | 6 |
| EMBODIMENT-3 | " | " | " | " | " | " | " | -- | -- | 12 |
| COMP. EX.-1 | " | " | " | " | " | " | " | -- | -- | 35 |
| COMP. EX.-2 | Cu | 95 | " | " | " | " | " | -- | -- | 2.5 |
| EMBODIMENT-4 | " | 80 | " | " | " | " | " | -- | -- | " |

*FIG. 1*

| | | | | | | | | | | |
|---|---|---|---|---|---|---|---|---|---|---|
| EMBODIMENT-5 | " | 75 | " | " | " | " | " | -- | -- | " |
| EMBODIMENT-6 | " | 40 | " | " | " | " | " | -- | -- | " |
| COMP. EX. 3 | " | 30 | " | " | " | " | " | -- | -- | " |
| COMP. EX.-4 | " | 75 | " | " | LESS THAN 0.1 | " | " | -- | -- | " |
| EMBODIMENT-7 | " | " | " | " | 0.7~20 | " | " | -- | -- | " |
| EMBODIMENT-8 | " | " | " | " | 70~150 | " | " | -- | -- | " |
| EMBODIMENT-9 | " | " | " | " | 100~150 | " | " | -- | -- | " |
| COMP. EX.-5 | " | " | " | " | MORE THAN 150 | " | " | -- | -- | " |
| EMBODIMENT-10 | " | " | " | " | 70~100 | Al | 0.01 | -- | -- | " |
| EMBODIMENT-11 | " | " | " | " | " | " | 0.1 | -- | -- | " |
| EMBODIMENT-12 | " | " | " | " | " | " | 1.0 | -- | -- | " |
| COMP. EX.-6 | " | " | " | " | " | " | 4.5 | -- | -- | " |

*FIG. 1* CONTINUATION

| CONDITION | CONTACT MATERIAL | | | | | | | | | |
|---|---|---|---|---|---|---|---|---|---|---|
| | HIGH CONDUCTIVITY CONSTITUENT | | ANTI-ARCING CONSTITUENT | | | FIRST AUXILIARY CONSTITUENT | | SECOND AUXILIARY CONSTITUENT | | RATIO OF VALUES OF THERMAL EXPANSION COEFFICIENT (%) |
| EMBODIMENTS COMPARATIVE EXAMPLES | TYPE | CONSTITUENT CONTENT (%) | TYPE | CONSTITUENT CONTENT (%) | PARTICLE SIZE ( $\mu$m) | TYPE | CONSTITUENT CONTENT (%) | TYPE | CONSTITUENT CONTENT (%) | |
| EMBODIMENT-13 | Cu | 75 | Cr | BALANCE | 70~100 | Si | 0.05 | -- | -- | 2.5 |
| EMBODIMENT-14 | " | " | " | " | " | Si+Al | " | -- | -- | " |
| EMBODIMENT-15 | " | " | " | " | " | Fe | " | -- | -- | " |
| EMBODIMENT-16 | " | " | " | " | " | Al | " | Bi | 0.05 | " |
| EMBODIMENT-17 | Cu | 95 | " | " | " | " | " | " | 0.1 | " |

*FIG. 2*

| | | | | | | | | | | |
|---|---|---|---|---|---|---|---|---|---|---|
| EMBODIMENT-18 | " | " | " | " | " | " | " | " | 1 | " |
| EMBODIMENT-19 | " | " | " | " | " | " | " | " | 5 | " |
| COMP. EX. 7 | " | " | " | " | " | " | " | " | 15 | " |
| EMBODIMENT-20 | " | " | " | " | " | " | " | Te | 4.0 | " |
| EMBODIMENT-21 | " | " | " | " | " | " | " | Sb | 0.2 | " |
| EMBODIMENT-22 | " | " | Cr99.9: Ti 0.1 | " | " | " | " | " | " | " |
| EMBODIMENT-23 | " | " | Cr95 : Ti 5 | " | " | " | " | " | " | " |
| EMBODIMENT-24 | " | " | Cr50 : Ti 50 | " | " | " | " | " | " | " |
| EMBODIMENT-25 | " | " | Cr95 : V 5 | " | " | " | " | " | " | " |
| EMBODIMENT-26 | " | " | Cr95 : Nb 5 | " | " | " | " | " | " | " |
| EMBODIMENT-27 | " | " | Cr95 : Ta 5 | " | " | " | " | " | " | " |
| EMBODIMENT-28 | " | " | Cr95 : Mo 5 | " | " | " | " | " | " | " |
| EMBODIMENT-29 | " | " | Cr95 : W 5 | " | " | " | " | " | " | " |

*FIG. 2* CONTINUATION

| CONDITION | CONTACT MATERIAL | | | | | | | | | |
|---|---|---|---|---|---|---|---|---|---|---|
| | HIGH CONDUCTIVITY CONSTITUENT | | ANTI-ARCING CONSTITUENT | | | FIRST AUXILIARY CONSTITUENT | | SECOND AUXILIARY CONSTITUENT | | RATIO OF VALUES OF THERMAL EXPANSION COEFFICIENT (%) |
| EMBODIMENTS COMPARATIVE EXAMPLES | TYPE | CONSTITUENT CONTENT (%) | TYPE | CONSTITUENT CONTENT (%) | PARTICLE SIZE (μm) | TYPE | CONSTITUENT CONTENT (%) | TYPE | CONSTITUENT CONTENT (%) | |
| EMBODIMENT-30 | Cu | 75 | Cr SURFACE COVERED WITH 2 μm OF Fe | BALANCE | 70~100 | Al | 0.05 | -- | -- | 2.5 |
| EMBODIMENT-31 | " | " | Cr SURFACE COVERED WITH 2 μm OF Ni | " | " | " | " | -- | -- | " |
| EMBODIMENT-32 | " | " | Cr SURFACE COVERED WITH 2 μm OF Co | " | " | " | " | -- | -- | " |

*FIG. 3*

| | | | | | | | | | | |
|---|---|---|---|---|---|---|---|---|---|---|
| EMBODIMENT-33 | " | " | Cr SURFACE COVERED WITH 2 μm OF Ti | " | " | " | " | -- | -- | " |
| EMBODIMENT-34 | " | " | Cr SURFACE COVERED WITH 2 μm OF V | " | " | " | " | -- | -- | " |
| EMBODIMENT-35 | " | " | Cr SURFACE COVERED WITH 2 μm OF Nb | " | " | " | " | -- | -- | " |
| EMBODIMENT-36 | " | " | Cr SURFACE COVERED WITH 2 μm OF Ta | " | " | " | " | -- | -- | " |
| EMBODIMENT-37 | " | " | Cr SURFACE COVERED WITH 2 μm OF Mo | " | " | " | " | -- | -- | " |
| EMBODIMENT-38 | " | " | Cr SURFACE COVERED WITH 2 μm OF W | " | " | " | " | -- | -- | " |
| EMBODIMENT-39 | Ag | 40 | Cr SURFACE COVERED WITH 2 μm OF Mo | " | " | " | " | -- | -- | " |
| EMBODIMENT-40 | " | " | Cr SURFACE COVERED WITH 2 μm OF W | " | " | " | " | -- | -- | " |
| COMP. EX-8 | Cu | 75 | Cr | PARTICLE OF ANTI-ARCING CONSTITUENT IN THE GRAIN SIZE RANGE OF 0.1 150 μm LESS THAN 90 VOLUME % | | " | " | -- | -- | " |

*FIG. 3* CONTINUATION

| | CONTACT RESISTANCE CHARACTERISTIC | TEMPERATURE RISE CHARACTERISTIC | BREAKING PERFORMANCE | NOTES |
|---|---|---|---|---|
| | CONTACT RESISTANCE BETWEEN COPPER ELECTRODE OF RADIUS OF CURVATURE 5R AND THE RESPECTIVE CONTACT PIECES (LOAD 10Kg, MEASUREMENT CURRENT DC 10A):$\mu\Omega$ | VALUE AFTER SUBTRACTING ROOM TEMPERATURE FROM THE TEMPERATURE OF THE TERMINALS OF THE VACUUM VALVE (RANGE OF GRAIN SIZE OF THE ANTI-ARCING CONSTITUENT 0.1~150$\mu$ m (EXCEPT FOR COMPARATIVE EXAMPLE-8)) | BREAKING LIMIT VALUE WHEN CURRENT WAS INCREASED IN 1KA STEPS AT 7.2KV, 50Hz (RELATIVE VALUES, TAKING THE VALUE OF EMBODIMENT-5 AS 1.0) | |
| EMBODIMENT-1 | 15~ 20 | 3~ 10 | 1.0 ~1.15 | |
| EMBODIMENT-2 | 15~ 30 | 5~ 12 | 0.95~1.0 | |
| EMBODIMENT-3 | 20~ 50 | 5~ 15 | 0.9 ~0.95 | |
| COMPARATIVE EXAMPLE-1 | 25~ 135 | 10~ 25 | 0.45~0.7 | |
| COMPARATIVE EXAMPLE-2 | 10~ 20 | 2~ 8 | TEST STOPPED DUE TO WELDING | EXCLUED FROM THE SCOPE OF THE PRESENT INVENTION |
| EMBODIMENT-4 | 15~ 25 | 4~ 10 | 0.95~ 1.1 | |
| EMBODIMENT-5 | 15~ 25 | 4~ 10 | 1.0 | |

*FIG. 4*

| | | | | |
|---|---|---|---|---|
| EMBODIMENT-6 | 25~50 | 6~16 | 0.95~1.0 | |
| COMPARATIVE EXAMPLE-3 | 35~115 | 12~32 | 0.7~0.8 | |
| COMPARATIVE EXAMPLE-4 | 15~20 | 3~23 | TEST STOPPED | EXCLUDED FROM THE SCOPE OF THE PRESENT INVENTION OF SINCE IT WAS DISADVANTAGEOUS IN REGARD TO INCREASED COST OF MANUFACTURING CONTACTS |
| EMBODIMENT-7 | " | 5~15 | 0.1~1.05 | |
| EMBODIMENT-8 | 15~25 | 5~10 | 1.0~1.1 | |
| EMBODIMENT-9 | 15~30 | 5~15 | 0.95~1.0 | |
| COMPARATIVE EXAMPLE-5 | 25~365 | 10~33 | 0.8~0.9 | |
| EMBODIMENT-10 | 15~20 | 2~5 | 0.95~1.0 | |
| EMBODIMENT-11 | " | 5~10 | 1.0~1.1 | |
| EMBODIMENT-12 | 20~35 | 10~15 | 0.9~0.95 | |
| COMPARATIVE EXAMPLE-6 | 35~95 | 28~42 | 0.6~0.75 | |

*FIG. 4* CONTINUATION

| | CONTACT RESISTANCE CHARACTERISTIC | TEMPERATURE RISE CHARACTERISTIC | BREAKING PERFORMANCE | NOTES |
|---|---|---|---|---|
| | CONTACT RESISTANCE BETWEEN COPPER ELECTRODE OF RADIUS OF CURVATURE 5R AND THE RESPECTIVE CONTACT PIECES (LOAD 10Kg, MEASUREMENT CURRENT DC 10A): $\mu\Omega$ | VALUE AFTER SUBTRACTING ROOM TEMPERATURE FROM THE TEMPERATURE OF THE TERMINALS OF THE VACUUM VALVE (RANGE OF PARTICLE SIZE OF THE ANTI-ARCING CONSTITUENT 0.1~150 $\mu$m (EXCEPT FOR COMPARATIVE EXAMPLE-8)) | BREAKING LIMIT VALUE WHEN CURRENT WAS INCREASED IN 1KA STEPS AT 7.2KV, 50Hz (RELATIVE VALUES, TAKING THE VALUE OF EMBODIMENT-5 AS 1.0) | |
| EMBODIMENT-13 | 15~25 | 3~10 | 0.9~ 1.05 | |
| EMBODIMENT-14 | " | 5~10 | 0.95~ 1.05 | |
| EMBODIMENT-15 | " | 7~10 | 0.9~ 1.0 | |

*FIG. 5*

| | | | | |
|---|---|---|---|---|
| EMBODIMENT-16 | " | 5~10 | 0.9~1.0 | |
| EMBODIMENT-17 | 15~30 | 5~12 | " | |
| EMBODIMENT-18 | " | 5~14 | 0.9~0.95 | |
| EMBODIMENT-19 | | 6~16 | " | |
| COMPARATIVE EXAMPLE-7 | 20~50 | 15~33 | 0.6~0.7 | EXCLUDED FROM THE SCOPE OF THE PRESENT INVENTION OF ACCOUNT OF SEVERE DROP OF VOLTAGE-WITHSTAND PERFORMANCE |
| EMBODIMENT-20 | 25~40 | 8~18 | 0.9~0.95 | |
| EMBODIMENT-21 | 20~40 | 6~15 | " | |
| EMBODIMENT-22 | 20~30 | 4~12 | 0.95~1.0 | |
| EMBODIMENT-23 | 20~40 | 5~15 | " | |
| EMBODIMENT-24 | 25~50 | 8~20 | " | |
| EMBODIMENT-25 | 25~45 | 6~17 | " | |
| EMBODIMENT-26 | 20~40 | 5~15 | " | |
| EMBODIMENT-27 | " | 4~13 | " | |
| EMBODIMENT-28 | 20~35 | 4~10 | " | |
| EMBODIMENT-29 | " | 4~8 | " | |

*FIG. 5* CONTINUATION

| | CONTACT RESISTANCE CHARACTERISTIC | TEMPERATURE RISE CHARACTERISTIC | BREAKING PERFORMANCE | NOTES |
|---|---|---|---|---|
| | CONTACT RESISTANCE BETWEEN COPPER ELECTRODE OF RADIUS OF CURVATURE 5R AND THE RESPECTIVE CONTACT PIECES (LOAD 10Kg, MEASUREMENT CURRENT DC 10A): $\mu\Omega$ | VALUE AFTER SUBTRACTING ROOM TEMPERATURE FROM THE TEMPERATURE OF THE TERMINALS OF THE VACUUM VALVE (RANGE OF GRAIN SIZE OF THE ANTI-ARCING CONSTITUENT 0.1~150 $\mu$m (EXCEPT FOR COMPARATIVE EXAMPLE-8)) | BREAKING LIMIT VALUE WHEN CURRENT WAS INCREASED IN 1KA STEPS AT 7.2KV, 50Hz (RELATIVE VALUES, TAKING THE VALUE OF EMBODIMENT-5 AS 1.0) | |
| EMBODIMENT-30 | 20~35 | 6~12 | 0.95~1.0 | |
| EMBODIMENT-31 | 20~30 | 5~10 | " | |
| EMBODIMENT-32 | 20~35 | 5~13 | " | |
| EMBODIMENT-33 | 25~40 | 7~16 | " | |
| EMBODIMENT-34 | " | 6~15 | " | |
| EMBODIMENT-35 | 25~35 | 6~14 | " | |
| EMBODIMENT-36 | " | 6~13 | " | |
| EMBODIMENT-37 | 20~35 | 5~14 | " | |
| EMBODIMENT-38 | " | 5~12 | " | |
| EMBODIMENT-39 | 10~20 | 4~12 | 0.9~0.95 | |
| EMBODIMENT-40 | " | 4~12 | " | |
| COMPARATIVE EXAMPLE-8 | 20~215 | 12~53 | 0.55~0.8 | |

*FIG. 6*

VACUUM VALVE

BACKGROUND OF THE INVENTION

1. Field of the Invention

The present invention relates to a vacuum valve having contact material that gives a stable contact resistance characteristic and current breaking characteristic and more particularly that has an excellent current breaking characteristic on interrupting.

2. Description of the Related Art

The contacts of a vacuum valve whereby current breaking is performed in hard vacuum by utilizing arc diffusion in vacuum comprise two contacts, namely, a fixed and a movable contact, facing each other.

Apart from the three fundamentals of large current breaking performance(i.e. current interrupter characteristic, hereinafter sometimes called breaking performance ), voltage-withstanding performance and anti-welding performance, the erosion characteristic of the contacts is an important requirement of a vacuum circuit breaker.

However, since some of these requirements are contradictory, it is not possible to satisfy all the requirements using a single type of metal. For this reason, in many contact materials that are practically employed, the contact material is selected to match the specific application such as for example large current use or high voltage withstanding ability by a combination of two or more elements that mutually compensate for each other's deficiencies. Although vacuum valves have been developed having excellent characteristics in specific applications, the present situation is that vacuum valves have not yet been developed that fully satisfy increasingly demanding requirements.

For example, for contacts intended for large current breaking performance, Cu—Cr alloy (see issued Japanese patent number Sho. 45-35101) containing about 50 weight % of Cr is known. This alloy shows benefits including that the Cr itself maintains practically the same vapor pressure characteristic as Cu and in addition shows a strong gas getter action, enabling a high-voltage and large-current breaking performance to be achieved. That is, Cu—Cr alloy is frequently used for contacts in which high withstand-voltage performance and large current breaking performance are combined.

Since in this alloy the highly active Cr is employed, in manufacture of the contact material (sintering step etc.) and in processing this contact material to produce the contact pieces, manufacture is conducted with especial care in regard to selection of the raw material powder, admixture of impurities, and control of the atmosphere etc. However, a perfect technique for supplying contact material combining simultaneously the voltage-withstanding performance and contact resistance characteristics required in order to obtain a vacuum valve with both high voltage-withstanding performance and large-capacity circuit breaking has not necessarily been achieved.

As a result of studying improvements in the composition of CuCr contacts, the present inventors became able to provide a vacuum valve equipped with excellent contact pieces combining voltage-withstanding performance and contact resistance characteristics.

The chief feature of CuCr contacts is that the vapor pressures of these two [elements] approximate to each other at high temperature; even after breaking they display comparatively smooth surface damage characteristics and exhibit stable electrical characteristics.

However, in recent years application to even larger current breaking or to circuits in which even higher voltage can be applied has become commonplace and severe wear and stubborn welding of the contacts are being experienced. Vacuum valve contacts that have suffered abnormal damage or wear due to breaking experience abnormal increase in contact resistance and/or rise in temperature when a steady current is next switched on or off and show impairment of voltage-withstanding ability. Abnormal damage or wear must therefore be suppressed to the maximum extent possible.

Investigations have revealed that the contact characteristics of CuCr alloys depend on variations of the Cr content of the alloy, the particle size distribution of the Cr particles, the degree of Cr segregation, and the level of voids present in the alloy. However, notwithstanding advances in optimisation in regard to the above, variability(i.e. dispersion) of the voltage-withstanding performance and contact resistance characteristic is experienced under the conditions of use described above that obtain in recent years, and in order to satisfy a given level of breaking performance it has become necessary for vacuum valves to have both of these characteristics.

SUMMARY OF THE INVENTION

Accordingly, one object of the present invention is to provide a novel vacuum valve of excellent breaking performance having contacts of stable contact resistance characteristic and breaking performance (current interrupter characteristic).

The above object of the present invention is achieved by a vacuum valve constituted as follows. Specifically, in a vacuum valve having contact material consisting of a constituent of high electrical conductivity comprising at least one of Cu or Ag and an anti-arcing constituent comprising Cr in which particles whose particle size is in the range 0.1~150 $\mu$m represent at least 90 volume % of the total particles, the ratio $[(\alpha_{900}-\alpha_{50})\times 100/(\alpha_{900})]$ for the contact material of the difference of the value of the coefficient of thermal expansion $\alpha_{900}$ at 900° C. and the value of the coefficient of thermal expansion $\alpha_{50}$ at 50° C. with respect to the value of the coefficient of thermal expansion $\alpha_{900}$ at 900° C. is to be at least 0.8% and less than 12%.

Thanks to its being constituted in this way, generation of channels at the interfaces between Cr particles and the Cu matrix after the contact material has undergone the brazing step can be suppressed, enabling the static voltage-withstanding performance and contact resistance characteristic to be stabilized and breaking performance to be stabilized. The reasons for choosing the thermal expansion coefficients a at 50° C. and 900° C. will now be explained. The thermal expansion coefficient represents the cumulative expansion of a material when a sample is heated from normal room temperature to the target temperature.

The reasons for particularly specifying 50° C. and 900° C. in the present invention are as follows. The contacts of a vacuum valve reach extremely high temperature an breaking of large current or being subjected to arcing. The contacts are then rapidly cooled. As a result, channels are formed between the Cr particles and Cu matrix. Measurement of the thermal expansion coefficient is performed in order to infer the extent of such channels. 50° C. is therefore the reference temperature and 900° C. is the temperature when large current flows in the contacts.

The upper limit temperature of measurement devices for thermal expansion coefficient is usually around 1000° C.

The thermal expansion coefficient of Cr is less than that of Cu so Cu also has the larger thermal contraction coefficient. Accordingly, when for example the contacts are subjected to arcing and are thereafter suddenly cooled, contraction of the Cu takes place leaving channels between the Cr and Cu and subsequent arcing may then concentrate in such channels.

This contact material may be a contact material obtained by uniformly mixing a constituent of high electrical conductivity comprising at least one of Cu or Ag and an anti-arcing constituent comprising Cr in which particles whose particle size is in the range 0.1~150 $\mu$m represent at least 90 volume % of the total particles to manufacture a mixed powder of "high electrical conductivity constituent powder/anti-arcing constituent powder" then adjusting the relative density of this mixed powder to at least 88% by heat treatment in a non-oxidizing atmosphere.

Adoption of such a composition confers the benefit of further suppressing production of channels at the interfaces between the Cr particles and Cu matrix after passing through the brazing step.

Also, this contact material may be a contact material constituted by a mixed powder [high electrical conductivity powder/anti-arcing powder/first adjuvant constituent powder] containing as high conductivity constituent an amount of 40~80 (weight) % of at least one of Cu or Ag, as first adjuvant constituent an amount of 0.01~1.0% of at least one element selected from Al, Si and Fe, and as a balance of prescribed amount, as anti-arcing constituent, Cr; obtained by heat treatment of this mixed powder at a temperature (for example the temperature is to be above the melting point in the case of the infiltration method) above the melting temperature of the high conductivity constituent in a non-oxidizing atmosphere or at a temperature above 800° C. but below the melting temperature of the high conductivity constituent (for example the temperature is to be below the melting temperature in the case of the solid phase sintering method)(but if the melting temperature of the high conductivity constituent is below 800° C., a temperature above the melting temperature of the high conductivity constituent).

The condition in regard to the channels produced at the interfaces between the Cr particles and the Cu matrix is further ameliorated by the presence of a prescribed amount of Al, Si or Fe as first adjuvant constituent.

Also, this contact material may be a contact material constituted by a mixed powder [high electrical conductivity powder/anti-arcing powder/second adjuvant constituent powder] or a mixed powder [high electrical conductivity powder/anti-arcing powder/first adjuvant constituent powder/second adjuvant constituent powder] containing as second adjuvant constituent an amount of 0.05~5% of one of Bi, Te or Sb; obtained by heat treatment of this mixed powder at a temperature above the melting temperature of the high conductivity constituent in a non-oxidising atmosphere or at a temperature above 800° C. but below the melting temperature of the high conductivity constituent (but if the melting temperature of the high conductivity constituent is below 800° C., a temperature above the melting temperature of the high conductivity constituent). Anti-welding properties may be improved by such a second adjuvant constituent such as Bi, Te or Sb.

Furthermore, this contact material may be a contact material obtained by producing a moulding by applying pressure to this mixed powder that is more than the pressure due just to the mixed powder's own weight and less than 8 ton/cm$^2$ then subjecting this moulding to heat treatment in a non-oxidising atmosphere at a temperature above the melting temperature of the high conductivity constituent or at a temperature above 800° C. but below the melting temperature of the high conductivity constituent (but if the melting temperature of the high conductivity constituent is below 800° C., a temperature above the melting temperature of the high conductivity constituent).

Also, the contact material may be a contact material having a layer of high conductivity constituent on at least one face obtained by placing (applying pressure if necessary) a Cu-containing material (for example Cu powder, thin Cu sheet, Cu alloy plate or AgCu alloy plate) in contact with the mixed powder then sintering this mixed powder with the Cu-containing material in a non-oxidizing atmosphere at a temperature above 800° C. but below the melting temperature of the high conductivity constituent (but if the melting temperature of the high conductivity constituent is below 800° C., a temperature above the melting temperature of the high conductivity constituent).

Further, this contact material may be a contact material obtained by substituting some of the Cr by one selected from Ti, V, Nb, Ta, Mo or W in the amount of at least 0.1% but less than 50% with respect to the Cr content.

By substituting some of the Cr by Ti, V, Nb, Ta, Mo or W, the voltage-withstanding performance is improved.

Also this contact material may be a contact material obtained by covering the surface of the Cr with one selected from Fe, Ni or Co in a thickness of 0.01~50 $\mu$m.

By covering with Fe, Ni or Co in this way, denaturing of the Cr powder in the mixing step can be reduced and adjustment of relative density (increasing the density) on sintering can be achieved.

Furthermore, this contact material may be a contact material obtained by covering the surface of the Cr with one selected from Ti, V, Nb, Ta, Mo or W, in a thickness of 0.01~50 $\mu$m.

By thus covering with Ti, V, Nb, Ta, Mo or W, denaturing of the Cr powder in the mixing step can be reduced and the voltage-withstanding performance is improved.

Also, this contact material may be a contact material obtained by a primary preparatory mixing beforehand of a prescribed amount of one or more elements selected from Al, Si and Fe with practically equal volume of one or more metals selected from Cu, Ag or Cr, then mixing the primary preparatory mixed powder obtained by the primary preparatory mixing with the balance of metal to obtain a mixed powder, which mixed powder is then moulded and sintered.

Also, this contact material may be a contact material obtained by a primary preparatory mixing beforehand of a prescribed amount of one or more elements selected from Bi, Te or Sb with practically equal volume of one or more metals selected from Cu, Ag or Cr, then mixing the primary preparatory mixed powder obtained by the primary preparatory mixing with the balance of metal to obtain a mixed powder, which mixed powder is then moulded and sintered.

Also, this contact material may be a contact material obtained by a secondary preparatory mixing of said primary preparatory mixed powder with practically equal volume of one or more metals selected from Cu, Ag or Cr, repeating if necessary a plurality of times the mixing operation in which a preparatory mixed powder is obtained by mixing this preparatory mixed powder with a practically equal volume balance of one or more metals selected from Cu, Ag or Cr. which preparatory mixed powder obtained is then mixed with the balance of the metal to obtain a mixed powder, this mixed powder being then moulded and sintered.

By employing a mixed powder which has been uniformly mixed by a mixing method as above in which preparatory mixing is performed, the effect of suppression of generation of channels can be further promoted.

BRIEF DESCRIPTIONS OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 1 is a table showing conditions of trial manufacture of Embodiments 1~12 of contact material for a vacuum valve according to the present invention and Comparative Examples 1~6;

FIG. 2 is a table showing conditions of trial manufacture of Embodiments 13~29 of contact material for a vacuum valve according to the present invention and Comparative Example 7;

FIG. 3 is a table showing conditions of trial manufacture of Embodiments 30~40 of contact material for a vacuum valve according to the present invention and Comparative Example 8;

FIG. 4 is a table showing evaluation results of Embodiments 1~12 of contact material for a vacuum valve according to the present invention and Comparative Examples 1~6;

FIG. 5 is a table showing evaluation results of Embodiments 13~29 of contact material for a vacuum valve according to the present invention and Comparative Example 7; and FIG. 6 is a table showing evaluation results of Embodiments 30~40 of contact material for a vacuum valve according to the present invention and Comparative Example 8.

DETAILED DESCRIPTION OF THE PREFERRED EMBODIMENTS

Referring now to the drawings, wherein like reference numerals designate identical or corresponding parts throughout the several views, and more particularly to FIG. 1 thereof, one embodiment of the present invention will be described. Even in the most modern switching plants(i.e. gears) and switching systems, erratic functioning or loss of function can occur due to defects of quality of contact components or defective performance of the material of only a single contact. The inventors perfected the present invention as a result of studying the contact materials used in vacuum valves and comparing vacuum valve characteristics. Specifically, the present invention is characterized by the following features.

It was found that some of the variability of electrical (or mechanical and chemical) performance of switching plants and switching systems as described above tends to be closely correlated with the contacts that are mounted in the vacuum valve. In particular it was found that variability is likely to occur after the brazing step has been carried out.

Specifically, in CuCr contact pieces under various conditions, when the static withstand-voltage performance and contact resistance characteristic with a contact needle/flat plate electrode facing each other under conditions of very smooth surface finishing with a mean value of the surface roughness Rave. of about 0.1 $\mu$m are examined, if the particle size and particle size distribution of the raw material Cr, and the constituents sintering conditions or sintering/infiltration conditions of the CuCr alloy etc. are to a certain degree fixed, practically the same static withstand-voltage performance and contact resistance characteristic are displayed between groups under the same conditions. However, when the static withstand-voltage performance and contact resistance characteristic after undergoing the brazing step were re-examined in detail after assembly of a vacuum valve using these contact pieces, a lowering and increased range of variability of the static withstand-voltage value and a rise and increased range of variability of the contact resistance characteristic were found to occur.

When the contact surface immediately after the brazing step was observed using a scanning type electron microscope, continuous or discontinuous channels of width chiefly about 0.1~10 $\mu$m were observed at the interfaces between the Cr particles and Cu matrix. Also a tendency was observed for the scars produced by electrical discharge on measurement of the static withstand-voltage to concentrate at the edges of these channels. In such cases a lowering of the static withstand-voltage performance and contact resistance characteristic as described above was observed, showing an adverse effect on the breaking performance of the vacuum valve. Specifically the presence etc. of channels found immediately after undergoing the brazing step as described above was related to variability of the static withstand-voltage performance and contact resistance characteristic after undergoing the brazing step as described above and also was inferred to affect breaking performance.

It was further established that the condition of the channels that are present in continuous or discontinuous condition as described above and that are found at the boundary between the Cr particles and the Cu matrix immediately after the brazing step tends to be closely associated with the Al and Si content of the CuCr. Specifically the presence of Al and Si contents within a fixed content range improves the condition of the channels as regards their width, continuous length, and depth etc. and is found to have a beneficial effect on the static withstand-voltage performance and contact resistance characteristic immediately after undergoing the brazing step.

Thus it is essential to control the condition of the channels referred to above which are present in continuous or discontinuous condition as referred to above and are seen at the interface between the Cr particles and Cu matrix at the surface of the contacts immediately after undergoing the brazing step such as to be within a prescribed range. Specifically, an embodiment of the present invention, as described above, provides CuCr wherein the drawback of production of channels which are present in continuous or discontinuous condition as referred to above and are generated at the interface between the Cr particles and Cu matrix at the surface of the CuCr contacts immediately after undergoing the brazing step is controlled.

In order to control the production of channels as described above, Cr powder of particle size 0.1~150 $\mu$m is selected as the raw material powder for the manufacture and Cr of particle size in the range of 0.1~150 $\mu$m is made to represent at least 90 volume % in the CuCr; and in addition, control of the channels mentioned above is achieved by making this CuCr alloy a material wherein the ratio $[(\alpha_{900}-\alpha_{50})\times 100/(\alpha_{900})]$ of the difference of the value of the coefficient of thermal expansion $\alpha_{900}$ at 900° C. i.e. the brazing temperature and the value of the coefficient of thermal expansion $\alpha_{50}$ at 50° C. with respect to the value of the coefficient of thermal expansion $\alpha_{900}$ at 900° C. is at least 0.8% and less than 12%. As a result, even after undergoing the brazing step, the production of channels generated at the interface between the Cr particles and the Cu matrix is suppressed, contributing to stabilisation of the static withstand-voltage performance and contact resistance characteristic and to stabilisation of the breaking performance. Furthermore, as described above, control of the Al and Si contents in the CuCr alloy has the effect of control of the production of channels.

CuCr material wherein the ratio $[(\alpha_{900}-\alpha_{50})\times100/(\alpha_{900})]$ of the difference of the value of the coefficient of thermal expansion $\alpha_{900}$ at 900° C. and the value of the coefficient of thermal expansion $\alpha_{50}$ at 50° C. with respect to the value of the coefficient of thermal expansion $\alpha_{900}$ at 900° C. greatly exceeds 12% tends to have unstable static withstand-voltage performance, contact resistance characteristic and breaking performance due to roughness of the contact surface produced in the brazing step and is therefore undesirable.

Also, if the above Al and Si content is below a fixed content (below 0.01%), there is little improvement in the condition of the channels while contrariwise if it is above a fixed content (above 1.0%), due to changes in the mechanical properties of the CuCr alloy material itself, the static withstand-voltage performance and contact resistance characteristic tend to be lowered. Variability of the Al and Si contents in the CuCr contacts also affects the condition of the channels which are present in continuous or discontinuous condition and are seen at the interface between the Cr particles and Cu matrix as referred to above and these also constitute a factor that adversely affects stability of the static withstand-voltage performance and contact resistance characteristic of the vacuum valve.

Furthermore, in addition to implementation of the above beneficial means for suppressing channels, CuCr alloy in which distribution of the Cr particles in the Cu matrix is made uniform beforehand or distribution of the Cr, Al, and Si etc. in the Cu matrix is made uniform is beneficial in suppressing generation of channels at the interface between the Cr particles and the Cu matrix after undergoing the brazing step.

For example, in order to obtain CuCr alloy in which the distribution of Cr particles in the Cu matrix is made uniform, in the case of 75% Cu—25% Cr, CuCr alloy may be employed which is produced using a raw material powder obtained by premixing (primary mixing) of the 25% Cr with practically the same amount of Cu and then again mixing this primary mixed powder which is thus obtained with the balance of the Cu (secondary mixing).

Also, a means of obtaining CuCr alloy wherein the Cr, Al and Si etc. are uniformly dispersed in the Cu matrix is to perform primary preparatory mixing beforehand of a prescribed amount of at least one element selected from Al, Si, Fe, Bi Te and Sb with practically the same volume of one or more metals selected from Cu, Ag, and Cr and then to thoroughly mix the primary mixed powder obtained by this primary mixing with the balance of Cu, Ag and Cr.

The contact material is obtained by moulding and sintering this mixed powder after thus mixing.

As described above, in order to stabilize the static withstand-voltage performance, contact resistance characteristic and breaking performance of CuCr alloy, it is essential to control channels which are present in continuous or discontinuous condition and are seen at the interface between the Cr particles and Cu matrix in the contact surface immediately after undergoing the brazing step.

The benefits of controlling the channels will be described with reference to the following specific examples.

Conditions of trial manufacture of embodiments manufactured on a trial basis and comparative examples are shown in FIG. 1 to FIG. 3, and evaluation results of these embodiments and comparative examples are shown in FIG. 4 to FIG. 6. The "ratio of thermal expansion values" in FIG. 4 to FIG. 6 is the ratio $[(\alpha_{900}-\alpha_{50})\times100/(\alpha_{900})]$ of the difference of the value of the coefficient of thermal expansion $\alpha_{900}$ at 900° C. and the value of the coefficient of thermal expansion $\alpha_{50}$ at 50° C. with respect to the value of the coefficient of thermal expansion $\alpha_{900}$ at 900° C.

The evaluation conditions and results relating to the contacts of these Embodiments and Comparative Examples will now be described. The contact resistance characteristic, temperature rise characteristic and breaking performance are as follows.

(a) Contact Resistance Characteristic

The contact resistance was found from the drop in potential between the two when a needle-shaped electrode of pure copper of radius of curvature 5 R was brought up opposite respective flat plate-shaped contact pieces under a contacting load of 10 Kg when a DC current of 10 A was passed.

(b) Temperature Rise Characteristic

The temperature rise characteristic was taken as the numerical value obtained by subtracting room temperature from the value obtained by measuring the surface temperature of the valve terminals in non-contacting fashion using a high-sensitivity infra-red thermometer, after incorporating the contact pieces in a vacuum valve.

(c) Breaking Performance

A breaking test was also conducted. For the breaking test, contacts of diameter 20 mm facing each other with a gap of 8 mm between the contacts were incorporated in a simple type of vacuum valve that was capable of disassembly and then, after conducting baking and voltage ageing etc., finding the breaking limit whilst increasing the current in 1 KA steps at 7.2 KV and 50 Hz.

The evaluations were conducted for three simple vacuum valves. FIG. 4 to FIG. 6 show a comparison in terms of relative values taking the data of the Cu—Cr contacts shown in Embodiment 5 as 1.0. With the exception of Comparative Example 8, all the examples in the Figure constituted contacts containing 90 volume % or more of particles of anti-arcing constituent with a particle size range of 0.1~150 μm.

Next, in implementation, for manufacture of the contacts, an appropriate choice, depending chiefly on the content of the anti-arcing constituent was made between for example the infiltration method, solid sintering method, and arc melting method.

For example, selecting the solid sintering method, in order to manufacture the contacts of the Embodiments of the present invention and the Comparative Examples, the Cu powder, Cr powder and Al powder were respectively adjusted to the prescribed particle ranges.

The Cr powder was classified in particle sizes of under 0.1 μm, 0.1~150 μm, and more than 150 μm. With the exception in particular of Comparative Example 8, control was effected by sieving etc. such that Cr powder of particle size 0.1~150 μm represented 90 volume %. The reason for this is that supply on an industrial scale of uniformly dispersed fine powder of under 0.1 μm particle size Cr for contacts is disadvantageous in regard to manufacturing costs and quality control of the contacts and is therefore excluded from the scope of the present invention. Also, above 150 μm is undesirable since this results in a severe rise in the contact resistance value and temperature rise characteristic.

These were respectively uniformly mixed to obtain [Cu·Cr] mixed powder or [Cu·Cr·Al] mixed powder. Next, this mixed powder was moulded using a press, to obtain a moulding, which was then sintered for about 1 hour at a sintering temperature of more than 850° C. (in the case of Ag, a temperature above 800° C. but below the melting point of Ag) but below the melting point of Cu in an atmosphere of degree of vacuum about $1\times10^{-3}$ Pa in for example hydrogen gas, argon gas, or nitrogen gas with a dew-point of about −70° C. or a vacuum atmosphere, to obtain a sintered body (sample contact material).

It is desirable that the pressure when forming the mixed powder with the press should be no more than 8 ton/cm$^2$. This is not only because if moulding is performed at more than 8 ton/cm$^2$, cracks tend to be formed in the moulding when this is removed from the mould, but also because moulding under pressures higher than this is uneconomic.

Sample contacts were obtained in which the relative density of the contacts was adjusted to 88% or more by repeating these steps (repeating the moulding and sintering) a plurality of times if necessary. The reason for this is that if the relative density is less than 88%, the erosion characteristic of the contacts is severely affected and a lot of gas is left in the contact material, impairing the withstand-voltage performance. Sample contacts were obtained by adjusting the contact density by for example suitable selection of sintering temperature and time. If the density is lower than 88%, the resistance to welding of the contacts is improved to the extent of ⅓~⅔ that of contacts of practically 100% relative density, but the erosion characteristic of the contacts is increased (deterioration of performance) to about 1.3~3.5 times that of contacts of practically 100% relative density and the withstand-voltage value tends to drop (deterioration of performance) by a factor of about 0.8~0.4 and in addition if silver brazing treatment is performed at 800° C., the silver brazing leaks to the surface layer of the contacts through the gaps in the interior of contacts of thickness 5 mm, further impairing the withstand-voltage performance. The employment of contacts of relative density at least 88% is therefore beneficial in manifesting the benefits of the present invention described below.

Also, the manufacture of contacts according to Embodiments of the present invention in which the infiltration method is selected is beneficial in the manufacture of CuCr of Cr content for example about 50% as shown in particular in Embodiment 6, Embodiments 39~40 and Comparative Example 3. The Cu powder, Cr powder and Al powder are respectively adjusted in the prescribed particle ranges. Cr powder or Cr·Al powder mixed if necessary with a small quantity of Cu powder is adjusted to the prescribed particle range and then calcined for about an hour at a calcining temperature above 850° C. but below the melting point of Cu (in the case of Ag, a temperature above 800° C. but below the melting point of Ag), for example 950° C. in an atmosphere of hydrogen gas, argon gas, or nitrogen gas with a dew-point of about −70° C. or a vacuum atmosphere of degree of vacuum about $1\times10^{-3}$ Pa to obtain temporary calcined bodies of for example Cr, CrCu, CrAl, CrAlCu, CrAg or CrAlAg. Sample contacts were then obtained by infiltration for one hour of Cu (Ag if the conductive constituent is Ag) into the residual cavities of these calcined bodies at a temperature above the melting point of Cu, for example 1150° C. (a temperature above the melting point of Ag, for example 1000° C., if the conductive constituent is Ag). In the case of some of the contacts, the sample contacts had their electrical conductivity adjusted by performing cooling whilst controlling the cooling rate of the cooling step after the infiltration step in a temperature zone of from the vicinity of solidification temperature to the vicinity of about 650° C. to prevent solid solution of large amounts of Cr in the Cu matrix (in the Ag matrix if the conductive constituent is Ag).

Further, in the manufacture of contacts according to Embodiments of the present invention in which the arc melting method is selected, sample contacts were provided by obtaining temporary calcined bodies by calcining rubber-pressed Cr powder or mixed powder consisting of CuCr, CrAl, CuCrAl, or CrAg etc. for about one hour at for example 800° C. in hydrogen or manufacturing a CuCrAl laminated plate obtained by laminating Cu (or Ag) with Cr and Al and then, using this as an electrode, melting using electron beam melting at for example 2000 A in argon and solidifying in a water-cooled copper crucible.

Further, in the manufacture of contacts according to Embodiments of the present invention in which the melt-spraying method is selected, sample contacts were provided by simultaneously spraying molten Cu (or Ag), molten Cr and molten Al onto the surface of a Cu sheet of thickness about 1~10 mm or by spraying molten CuCrAl (or Ag) and solidifying. Further, in the manufacture of contacts according to Embodiments of the present invention in which the direct fusion method is selected, CuCrAl sample contacts were provided by directly projecting for example an electron beam onto a solid mixed body consisting of CrAl or onto a mixed body of Cu(or Ag)CrAl arranged on the surface of a Cu (or Ag) sheet and then fusing with part or all of the Cu (or Ag) sheet.

As the sample Cr powder, Cr powder on its own as mentioned above is satisfactory but, as shown in Embodiments 30~38 denaturing of the Cr powder in the mixing step can be reduced by using Cr powder whose surface is covered beforehand with Fe, Ni, Co, Ti, V, Nb, Ta, W or Mo of thickness 0.01~50 $\mu$m; a suitable choice may be made depending on requirements.

Also, since the amounts of the first adjuvant constituent such as Al or second adjuvant constituent such as Bi are extremely minute compared with the amounts of the high-conductivity constituent such as Cu or the anti-arcing constituent such as Cr, the mixture of these is carefully controlled. In order to achieve this more reliably, mixing may be performed by a primary mixing of a quantity of the first adjuvant constituent or second adjuvant constituent with practically the same amount of the high-conductivity constituent or the anti-arcing constituent, followed by mixing of the primary mixed powder which is thus obtained with the balance of the high-conductivity constituent or anti-arcing constituent. This was done when required since it is beneficial in enabling a uniformly dispersed mixture to be obtained.

Moreover, since the further subsequent performance of heat treatment at at least 350° C. in a non-oxidising atmosphere is beneficial in regard to contacts obtained by any of these methods of manufacture in adjusting the hardness, processing characteristics and electrical conductivity etc. of the contacts, this is performed as required. Whichever of the above methods is selected, control of the ratio of thermal expansion coefficients at 900° C. and 50° C. in the prescribed range enables the beneficial qualities of the contact material produced to be manifested to a greater extent and so is advantageous in achieving the object of the invention.

Evaluation results of the Embodiments and Comparative Examples are as follows.

(Embodiments 1~3, Comparative Example 1)

In order to elucidate the effect on the various characteristics of controlling the value of the ratio $[(\alpha_{900}-\alpha_{50})\times100/(\alpha_{900})]$ of the difference of the value of the coefficient of thermal expansion of the contact material $\alpha_{900}$ at 900° C. and the value of the coefficient of thermal expansion $\alpha_{50}$ at 50° C. with respect to the value of the coefficient of thermal expansion $\alpha_{900}$ at 900° C. to a prescribed value, first of all, sieving was performed such as to make particles of Cr anti-arcing constituent of particle size in the range 70~100 μm represent more than 90 volume %, and, after making the Cu content 75% and the Al content 0.05%, 75%Cu—Cr—Al contacts were manufactured wherein the value of $[(\alpha_{900}-\alpha_{50})\times100/(\alpha_{900})]$ was varied in the range 0.8~35 (%). In this manufacture, Cr powder wherein the content of Al in the raw material Cr powder was adjusted in the vicinity of 0.002%~ the vicinity of 0.1 was suitably selected as starting material powder, and, to control the value of $[(\alpha_{900}-\alpha_{50})\times100/(\alpha_{900})]$, adjustment of the particle size distribution in the particle size range of 0.1~150 μm, the addition of substances volatile at low temperature and their amounts with respect to the Cr powder used, and adjustment of the moulding pressure, sintering (infiltration) temperature, sintering time, and cooling rate etc. were suitably performed. Obtaining a product in which the value of $[(\alpha_{900}-\alpha_{50})\times100/(\alpha_{900})]$ is in the vicinity of 12% can easily be achieved by setting the moulding pressure and sintering temperature on the low side.

The contacts manufactured were mounted in the simple demountable vacuum valve described above and the temperature rise characteristic and breaking performance mentioned above were evaluated. Also a needle-shaped electrode of pure copper of radius 5 R and the various contact pieces of flat plate shape were mounted in a demountable contact resistance measurement device and brought up facing each other under a contact weight of 10 Kg, and the contact resistance characteristic evaluated by finding the potential drop between the two when a DC current of 10 A was passed. The results are shown in FIG. 4.

Comparing the contact resistance characteristic, temperature rise characteristic and breaking performance when the value of $[(\alpha_{900}-\alpha_{50})\times100/(\alpha_{900})]$ was 0.8~12% (Embodiments 1~3) with the characteristics of Embodiment 5, which was taken as the reference sample, it was found that these were likewise in practically the same range of preferred values as Embodiment 5 constituting the reference contacts described below. However, when the value of $[(\alpha_{900}-\alpha_{50})\times100/(\alpha_{900})]$ was made 35% (Comparative Example 1), these characteristics showed a severe drop.

Consequently, from the implementation results described above, regarding the benefits of controlling the value of $[(\alpha_{900}-\alpha_{50})\times100/(\alpha_{900})]$ to a prescribed value, this is preferably in the range of 0.8~12%.

Furthermore, when a scanning type electron microscope was used to observe the surface of contacts after silver brazing bonding treatment and contacts after a breaking test, it was found that, in the case of the contacts of Comparative Example 1, continuous or discontinuous channels were present between the Cr particles and the Cu matrix surrounding the Cr particles. In particular, in the case of contacts subjected to the breaking test, these channels were wide and deep and were continuous along the periphery of the Cr particles. Furthermore, built-up areas were observed along the edges of the channels, impairing the micro-smoothness of the contact surface. This condition appears to be associated with the characteristics shown in FIG. 4.

In contrast, in the case of Embodiments 1~3, the channels of the contacts after silver brazing treatment were narrow and the edges of the channels were flat with no buildup, presenting a desirable surface condition which contributed to stabilisation of the contact resistance characteristic and temperature rise characteristic.

(Embodiments 4~6, Comparative Examples 2~3)

Results are shown illustrating the effect of the value of $[(\alpha_{900}-\alpha_{50})\times100/(\alpha_{900})]$ when, for example, the amount of the conductive constituent Cu in the CuCr was selected as 75%, the particle size of the anti-arcing constituent Cr employed was selected as 70~100 μm, and the first adjuvant constituent was selected as Al, its content being selected as 0.05%, in Embodiments 1~3 and Comparative Example 1.

The results of examination when the value of $[(\alpha_{900}-\alpha_{50})\times100/(\alpha_{900})]$ was made 2.5% and the content of the conductive constituent Cu was selected to be in the range 30~95% will now be described.

For contents of the conductive constituent Cu in the range 75~80% Embodiments 4~5), the contact resistance characteristic, temperature rise characteristic and breaking performance showed desirable characteristics when compared Is with the characteristics of the reference contacts of Embodiment 5. Embodiment 5 was chosen as the reference contact. Further, at 40% (Embodiment 6), practically equivalent desirable characteristics were displayed, though the contact resistance characteristic and temperature rise characteristic tended to increase somewhat.

In contrast, in the case where the amount of conductive constituent Cu is 30% (Comparative Example 3), the contact resistance characteristic and temperature rise characteristic tend to show severe variability and breaking performance is seriously impaired i.e. undesirable characteristics are displayed.

Accordingly, from the results described above, it can be seen that the benefit according to the present invention where the value of $[(\alpha_{900}-\alpha_{50})\times100/(\alpha_{900})]$ is controlled to the prescribed value is manifested in contacts where the Cu content in Cu—Cr—Al contacts is in the range of 40~80%.

Incidentally, when the 40%Cu—Cr—Al contacts shown in Embodiment 6 were manufactured and supplied by the arc fusion method in which CuCr obtained by laminating a plurality of sets of Cu sheets and Cr sheets of prescribed ratio was used as the consumption electrode and compared with contacts respectively manufactured by the solid sintering method or infiltration method, it was found that the contacts produced by the arc fusion method tended to be superior in particular in regard to erosion characteristic performance and contacts produced by the solid sintering method tended to be superior in particular in regard to anti-melting performance and contacts produced by the infiltration method tended to be superior in particular in regard to breaking performance, they all showed performance within the allowed range so it can be seen that a method of manufacture according to the present invention which exhibits the benefit of addition of Al and/or Si as the first adjuvant constituent is practically advantageous in all these cases.

Furthermore, in the middle of a water-cooled crucible of internal diameter 50 mm, a Cu plate of external diameter about 50 mm, thickness about 6 mm and a moulding of diameter 50 mm, thickness about 1 mm formed by moulding a mixed powder mixed in a ratio of approximately 75% Cu powder, 0.1% Al powder, balance Cr were arranged lying one on top of another. The surface of the Cu—Al—Cr moulding was then irradiated with an electron beam whose beam depth, beam focus, irradiation time and irradiation speed were adjusted such as to melt it and achieve simultaneous fusion of part of the surface of the Cu sheet arranged thereunder, thereby producing a contact blank. After processing to the prescribed shape, this was then likewise supplied for electrical evaluation. It was found that the benefit according to the present invention of controlling the value of $[(\alpha_{900}-\alpha_{50})\times100/(\alpha_{900})]$ to the prescribed value was fully exhibited and, when compared with the characteristics of Embodiment 5 constituting the reference sample, it was found that the contact resistance characteristic, temperature rise characteristic and breaking performance were practically in the same preferred range.

(Embodiments 7~9, Comparative Examples 4~5)

Embodiments 1~6 described above showed benefits when, in Comparative Examples 1~3, the particle size of the anti-arcing constituent Cr that was employed was 70~100 μm. However, it was found in the present invention that benefits are still obtained even if the particle size is varied in a prescribed range, not restricted to this.

Specifically, in order to elucidate the beneficial effects on the various characteristics, first of all, keeping the Cu content practically constant at 75%, and using as first adjuvant constituent 0.05% of Al, 75%Cu—Cr—Al contacts were manufactured in which the particle size of the anti-arcing constituent Cr was varied in the ranges: less than 0.1 μm, 0.1~150 μm, and over 150 μm. (Embodiments 7~9, Comparative Examples 4~5).

In the manufacture of the contact material, since the Al content in the raw material Cr powder was small, Cr powder was used taking the same measures as were described in connection with preceding Embodiments.

The manufactured contacts were mounted in a demountable simple vacuum valve as described above and the contact resistance characteristic, temperature rise characteristic and, for reference, the breaking performance were evaluated. The results are shown in FIG. 4.

As can be seen from FIG. 4, in the case where the particle size of the anti-arcing constituent Cr used in the 75%Cu—Cr—Al was under 0.1 μm (Comparative Example 4), when compared with the characteristics of Embodiment 5 which was taken as the reference sample, although the contact resistance characteristic and temperature rise characteristic were both in the desired range, the supply on an industrial scale of fine powder having active properties and uniform dispersion thereof are disadvantageous in terms of contact manufacturing costs and quality control so this is excluded from the scope of the present invention.

In the case of the over 150 μm range (Comparative Example 5), in comparison with Embodiment 5 which was taken as the reference sample, large increases and variability were seen in both the mean value and maximum value of the contact resistance characteristic and in addition a severe drop in performance was seen in the case of the temperature rise characteristic. In particular metal microscopic observation of the cross-section of the contact after a breaking test revealed large production of long continuous cracks originating at the interfaces of giant Cr particles of over 150 μm with the Cu.

In the case of the contacts using Cr of the remaining particle size, production of cracks was found to be small for the same Cr content. The results were in practically the same preferred range as Embodiment 5 which was taken as the reference sample for particle sizes of the anti-arcing constituent Cr of 0.1~20 μm, 70~150 μm, and 100~150 μm (Embodiments 7~9).

Consequently, from the above results, in order to fully manifest the benefits of controlling the value of $[(\alpha_{900}-\alpha_{50})\times100/(\alpha_{900})]$ to a prescribed value according to the present invention, it is preferable to make the particle size of the anti-arcing constituent Cr of the contacts in the range 0.1~150 μm.

(Embodiments 10~12, Comparative Example 6)

In order to elucidate the benefits of the first adjuvant constituent (Al content) on the various characteristics, after first of all making the Cu content approximately 75%, 75%Cu—Cr—Al contacts were manufactured (Embodiments 10~12, Comparative Example 6) in which the Al content was varied in the range 0.01~4.5%. In the manufacture a suitable choice as starting point powder was made of Cr powder adjusted to have an Al content of in the vicinity of 0.002%~ in the vicinity of 0.1% in the raw material Cr powder.

In putting the present invention into practice, as in Embodiments 1~40 and Comparative Examples 1~5 and 7~8 (with the exception of Comparative Example 6), in order to manufacture contacts containing extremely small contents of Al such as Al contents of 0.01~0.1%, a method was adopted in which only the amount represented by subtracting the Al content of the raw material Cr powder (starting point powder) from the target Al content was added in the mixing step.

Also, specifically, since the Al content is in terms of quantity a very slight amount, a uniformly mixed powder was obtained by a system wherein one or other of Cu and Cr is first mixed with the Al content in practically the same amount (same volume)(primary mixed powder) and the thus-obtained primary mixed powder is then subjected to a secondary mixing with practically the same amount (same volume) of Cu (secondary mixing). After thorough mixing of the thus-obtained uniformly mixed powder with Cu and Cr, this was moulded at for example 7 ton/cm$^2$ and sintered in vacuum at 1000° C. to obtain 75%Cu—Cr—Al contact material which was then processed to the prescribed shape to produce the contacts.

On the other hand, when the target Al content is larger as 4.5% (Comparative Example 6), although primary mixed powder and secondary mixed powder could be produced as described above, this method is not essential and the target constituent contents could be obtained by the ordinary method of directly mixing Cu, Cr and Al powder.

As is clear from FIG. 4, when the Al content in the contacts was 0.01~1.0% (Embodiments 10~12), on comparison with the characteristics of Embodiment 5 representing the reference sample, it was found that the contact resistance characteristic, temperature rise characteristic and breaking performance tested at 7.2 KV and 50 Hz by increasing the current in 1 KA steps were in practically the same preferred range.

However, in the case of 4.5% Al content of the contacts (Comparative Example 6), on comparison with the characteristics of Embodiment 5 representing the reference sample, it was found that large increases and variability(dispersion) were seen in both the contact resistance characteristic and temperature rise characteristic and furthermore there was severe deterioration of the breaking performance.

Consequently, from the above results, it can be seen that the benefits of controlling the value of $[(\alpha_{900}-\alpha_{50})\times100/(\alpha_{900})]$ to a prescribed value are manifested in a range of Al content in the contacts of 0.01~1.0% (Embodiments 10~12)

(Embodiments 13~15)

In the above embodiments 10~12, the Cu content was made practically 75% the particle size of the anti-arcing constituent Cr used 70~100 μcm, and the value of $[(\alpha_{900}-\alpha_{50})\times100/(\alpha_{900})]$ was fixed at 2.5%. The effect of the first adjuvant constituent (Al content) was then investigated; it was shown that CuCrAl contacts with an Al content of 0.01~1.0% effectively manifest the benefit of controlling the value of $[(\alpha_{900}-\alpha_{50})\times100/(\alpha_{900})]$ to a prescribed value.

It is not the case that the benefit of controlling the above value of $[(\alpha_{900}-\alpha_{50})\times100/(\alpha_{900})]$ to a prescribed value is exhibited only when the first constituent is Al. Even contacts containing Si, Si+Al, or Fe (Embodiments 13~15) exhibited a practically equivalent contact resistance characteristic and temperature rise characteristic when compared with Embodiment 5 which was used as reference; their breaking performance was also excellent.

(Embodiments 16~21, Comparative Example 7)

The effect of controlling the value of $[(\alpha_{900}-\alpha_{50})\times100/(\alpha_{900})]$ to a prescribed value was illustrated for contacts constituted by Cu (high conductivity constituent) and Cr (anti-arcing constituent) and first adjuvant constituent (Al, Si or Fe) by the above Embodiments 1~15 and Comparative Examples 1~6. However, the effect of controlling the value of $[(\alpha_{900}-\alpha_{50})\times100/(\alpha_{900})]$ to a prescribed value according to the present invention is not restricted to the above compositions, and it was found that benefits are manifested even more effectively by contact material to which a second adjuvant constituent has been added.

In Cu—Cr—Al based contacts containing a second adjuvant constituent such as Bi, Te or Sb to improve anti-welding performance, an anti-welding effect was indeed exhibited and in fact an enormous improvement was seen. Furthermore, when a comparison was made with the characteristics of Embodiment 5 which was used as the reference sample, as shown in FIG. 5, the contact resistance characteristic, temperature rise characteristic and breaking performance were found to be in practically the same preferred range (Embodiments 16~21).

However, when the content of the second adjuvant constituent was 15% (Comparative Example 7), although anti-welding performance was excellent, when a comparison was made with the characteristics of Embodiment 5 which was used as the reference sample, it was found that the contact resistance value was large and showed a high degree of variability; also the temperature rise value was high. Furthermore, a severe drop was seen in the breaking performance and voltage-withstanding ability. Thus the benefit of controlling the value of $[(\alpha_{900}-\alpha_{50})\times100/(\alpha_{900})]$ in this invention to the prescribed value was lost and the result was unsatisfactory.

The benefit of controlling the value of $[(\alpha_{900}-\alpha_{50})\times100/(\alpha_{900})]$ to the prescribed value according to the present invention is therefore exhibited when the value of the content of the second adjuvant constituent is made 0.05~5%.

(Embodiments 22~29)

In the Embodiments 1~21 described above, Cr was employed as a typical anti-arcing constituent but the benefit of controlling the value of $[(\alpha_{900}-\alpha_{50})\times100/(\alpha_{900})]$ in the present invention to a prescribed value is not restricted to Cr.

Specifically, when 99.9%Cr—Ti, 95%Cr—Ti, 50%Cr—Ti, 95%Cr—V, 95%Cr—Nb, 95%Cr—Ta, 95%C—-Mo, or 95%Cr—W was employed instead of Cr, when a comparison was made with the characteristics of Embodiment 5 which was used as the reference sample, the contact resistance characteristic, temperature rise characteristic and breaking performance were found to be in practically the same preferred range (Embodiments 22~29).

(Embodiments 30~38)

In the Embodiments 1~21 described above, Cr was employed as a typical anti-arcing constituent but the benefit of controlling the value of $[(\alpha_{900}-\alpha_{50})\times100/(\alpha_{900})]$ in the present invention to a prescribed value is not restricted to Cr or Cr alloys.

Specifically, when Cr whose surface is covered with Fe, Ni, Co, Ti, V, Nb, Ta, Mo or W was employed instead of Cr, when a comparison was made with the characteristics of Embodiment 5 which was used as the reference sample, the contact resistance characteristic, temperature rise characteristic and breaking performance were found to be in practically the same preferred range (Embodiments 30~38).

For the method of covering, ordinary techniques such as electrical plating, sputtering, or ion plating were employed.

(Embodiments 39~40)

In the Embodiments 1~38 described above, Cu was employed as a typical high-conductivity constituent but the benefit of controlling the value of $[(\alpha_{900}-\alpha_{50})\times100/(\alpha_{900})]$ in the present invention to a prescribed value is not restricted to this.

Specifically, when the high-conductivity constituent was Ag, when a comparison was made with the characteristics of Embodiment 5 which was used as the reference sample, the contact resistance characteristic, temperature rise characteristic and breaking performance were found to be in practically the same preferred range (Embodiments 39~40).

(Comparative Example 8)

In the Embodiments 1~40 described above, the benefit of controlling the value of $[(\alpha_{900}-\alpha_{50})\times100/(\alpha_{900})]$ according to the present invention to the prescribed value was amply manifested when the particle size of the Cr (CrTi alloy, Cr covered with Ti) etc. was made 0.1 $\mu$m~150 $\mu$m. If the volume percentage of particle size 0.1 $\mu$m~150 $\mu$m of the total of anti-arcing constituents in the contacts alloy is less than 90 volume %, severe variability of the contact resistance characteristic, temperature rise characteristic and breaking performance is seen, and the benefit of controlling the value of $[(\alpha_{900}-\alpha_{50})\times100/(\alpha_{900})]$ to the prescribed value according to the present invention cannot therefore be fully exhibited.

(Modified Example 1)

A prescribed Cu sheet (Cu powder, thin Cu sheet, Cu alloy sheet, AgCu alloy sheet etc.) was placed on top of and in contact with a mixed powder as referred to above, applying pressure if necessary. This mixed powder was then sintered together with the Cu sheet in a temperature range of over 800° C. and below the melting temperature of Cu or Ag in a non-oxidising atmosphere to obtain a contact blank having a layer of highly conductive constituent on at least one face, the Cu sheet face being used as a bonding face; this is thereby beneficial in improving silver brazing characteristics.

As described above, with the present invention a vacuum valve can be provided having excellent stability of contact resistance characteristic and breaking performance.

Obviously, numerous additional modifications and variations of the present invention are possible in the light of the above teachings. It is therefore to be understood that within the scope of the appended claims, the invention may be practised otherwise than as specially described herein.

What is claimed as new and desired to be secured by Letters Patent of the United States is:

1. A vacuum valve having a contact material consisting of a constituent of high electrical conductivity comprising at least one of Cu or Ag, an anti-arcing constituent comprising Cr in which particles whose particle size is in the range 0.1~150 $\mu$m represent at least 90 volume % of the total particles, wherein:

a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

2. A vacuum valve having a contact material obtained by uniformly mixing a constituent of high electrical conductivity comprising at least one of Cu or Ag and an anti-arcing constituent comprising Cr in which particles whose particle size is in the range 0.1~150 $\mu$m represent at least 90 volume % of the total particles to manufacture a mixed powder of "high electrical conductivity constituent powder/anti-arcing constituent powder" then adjusting the relative density of said mixed powder to at least 88% by heat treatment in a non-oxidizing atmosphere, wherein:

a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

3. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles, and a first adjuvant constituent comprising at least one of Al, Si or Fe, wherein:

said contact material is prepared by mixing a powder containing said high electrical conductivity constituent in an amount of 40~80 weight %, and a powder of a first adjuvant constituent in an amount of 0.01~1.0 weight %, the balance consisting of anti-arcing constituent Cr powder, and said mixed powder is heated to a temperature above 800° C. but below the melting temperature of said high conductivity constituent, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

4. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles, a first adjuvant constituent comprising at least one of Al, Si or Fe, a second adjuvant constituent comprising 0.05~5% of at least one of Bi, Te or Sb, wherein:

said contact material is prepared by mixing a powder containing said high electrical conductivity constituent in an amount of 40~80 weight %, and a powder of said first adjuvant constituent in an amount of 0.01~1.0 weight %, the balance consisting of anti-arcing constituent Cr powder, and said mixed powder is heated to a temperature above 800° C. but below the melting temperature of said high conductivity constituent, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

5. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles, and an optional first adjuvant constituent comprising at least one of Al, Si or Fe and an optional second adjuvant constituent comprising at least one of Bi, Te or Sb, wherein:

said contact material is produced by applying pressure to a mixed powder of said constituent of high electrical conductivity, said anti-arcing constituent, said optional first adjuvant constituent, and said optional second adjuvant constituent, to form a molding, and said pressure is more than the pressure due just to said mixed powder's own weight and less than 8 ton/cm$^2$, then heat treating said molding in a non-oxidizing atmosphere at a temperature above 800° C. but below the melting temperature of said high conductivity constituent, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

6. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles, an optional first adjuvant constituent comprising at least one of Al, Si or Fe, and an optional second adjuvant constituent comprising at least one of Bi, Te or Sb, wherein:

said contact material has a layer of said high electrical conductivity constituent on at least one face, and said layer is prepared by placing a Cu-containing material in contact with a mixed powder of said high electrical conductivity constituent, said anti-arcing constituent and said optional first adjuvant constituent, and said optional second adjuvant constituent, applying pressure to said powder if necessary, and then heating-treating said mixed powder together with said Cu-containing material in a non-oxidizing atmosphere at a temperature above 800° C., and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

7. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles, an optional first adjuvant constituent comprising at least one of Al, Si or Fe, and an optional second adjuvant constituent comprising one of Bi, Te or Sb, wherein:

some of said Cr is substituted with one of Ti, V, Nb, Ta, Mo and W in an amount of at least 0.1% but less than 50% with respect to said Cr content, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

8. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles as a main anti-arcing constituent and at least one constituent comprising at least one of the group consisting of Ti, V, Nb, Ta, Mo and W if required, a first adjuvant constituent comprising at least one of Al, Si or Fe, and a second adjuvant constituent comprising at least one of Bi, Te or Sb, wherein:

a surface of said Cr is coated with at least one element selected from Fe, Ni or Co in a thickness of 0.01~50 μm, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

9. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles as a main anti-arcing constituent and at least one of Ti, V, Nb, Ta or Mo, a first adjuvant constituent comprising at least one of Al, Si or Fe, and a second adjuvant constituent comprising at least one of Bi, Te or Sb, wherein:

said contact material is obtained by coating a surface of said Cr with at least one of Ti, V, Nb, Ta, Mo or W in a thickness of 0.01~50 μm, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

10. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles as a main anti-arcing constituent and an optional anti-arcing constituent of at least one of Ti, V, Nb, Ta and Mo, a first adjuvant constituent comprising at least one of Al, Si or Fe, and a second adjuvant constituent comprising at least one of Bi, Te or So, wherein:

said contact material is obtained by mixing one or more of Al, Si or Fe with an approximately equal volume of one or more metals selected from Cu, Ag or Cr to form a preparatory mixed powder, mixing said preparatory mixed powder with a remainder of the constituents of said contact material to form a mixed powder, then molding and sintering said mixed powder, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

11. A vacuum valve having a contact material consisting of a constituent of high electrical conductivity comprising at least one of Cu or Ag, an anti-arcing constituent comprising Cr in which particles whose particle size is in the range 0.1~150 μm represent at least 90 volume % of the total particles as a main anti-arcing constituent and an optional anti-arcing constituent of at least one of Ti, V, No, Ta or Mo, a first adjuvant constituent comprising at least one of Al, Si or Fe, and a second adjuvant constituent comprising at least one of Bi, Te or Sb, wherein:

surfaces of said anti-arcing constituent Cr are optionally coated with one element selected from Fe, Ni, Co, Ti, V, Nb, Ta, Mo or W in a thickness of 0.01~50 μm, said contact material is obtained by mixing one or more elements selected from Bi, Te or Sb with an approximately equal volume of one or more metals selected from Cu, Ag or Cr, to form a preparatory mixed powder, mixing said preparatory mixed powder with a remainder of the constituents of said contact material to form a mixed powder, then molding and sintering said mixed powder, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

12. A vacuum valve having contact material consisting of a constituent of high electrical conductivity comprising at least one of Cu or Ag, an anti-arcing constituent comprising Cr in which particles whose particle size is in the range 0.1~50 μm represent at least 90 volume % of the total particles as a main anti-arcing constituent and an optional anti-arcing constituent comprising at least one of Ti, V, Nb, Ta or Mo, a first adjuvant constituent comprising at least one of Al, Si or Fe, and a second adjuvant constituent comprising one of Bi, Te or Sb, wherein:

surfaces of said anti-arcing constituent Cr are optionally coated with one element selected from Fe, Ni, Co, Ti, V, No, Ta, Mo or W in a thickness of 0.01~50 μm, said contact material is obtained by mixing one or more elements selected from Al, Si, Fe, Bi, Te or Sb with an approximately equal volume of one or more metals selected from Cu, Ag or Cr, to form a preparatory mixed powder, mixing said preparatory mixed powder with a remainder of the constituents of said contact material to form a mixed powder, then molding and sintering said mixed powder, and a ratio defined by the formula $(\alpha_{900}-\alpha_{50})\times100/(\alpha_{900})$ for said contact material has a value of at least 0.8% and less than 12% wherein $\alpha_{900}$ is the value of the coefficient of thermal expansion of said contact material at 900° C. and $\alpha_{50}$ is the value of the coefficient of thermal expansion of said contact material at 50° C.

* * * * *